US006176750B1

(12) United States Patent
Alexander et al.

(10) Patent No.: US 6,176,750 B1
(45) **Date of Patent: *Jan. 23, 2001**

(54) MARINE PROPULSION UNIT WITH HYDRAULIC PUMP

(75) Inventors: Charles F. Alexander, Austin, TX (US); Daniel F. McCormick, Oshkosh, WI (US)

(73) Assignee: Brunswick Corporation, Lake Forest, IL (US)

( * ) Notice: Under 35 U.S.C. 154(b), the term of this patent shall be extended for 0 days.

This patent is subject to a terminal disclaimer.

(21) Appl. No.: 09/379,758

(22) Filed: Aug. 24, 1999

Related U.S. Application Data

(63) Continuation of application No. 08/904,072, filed on Jul. 31, 1997, now Pat. No. 6,062,926, which is a continuation-in-part of application No. 08/719,633, filed on Sep. 25, 1996, now Pat. No. 5,766,047.

(51) Int. Cl.[7] ..... B63H 20/20
(52) U.S. Cl. ..... 440/75; 440/80; 416/129
(58) Field of Search ..... 440/75, 80, 81, 440/88; 416/128, 129; 192/3.57, 3.58, 21, 51

(56) References Cited

U.S. PATENT DOCUMENTS

| | | | | |
|---|---|---|---|---|
| 2,672,115 | | 3/1954 | Conover . | |
| 2,989,022 | | 6/1961 | Lundquist . | |
| 3,146,755 | * | 9/1964 | Morse | 440/75 |
| 3,217,688 | * | 11/1965 | Warburton, II | 440/75 |
| 3,478,620 | | 11/1969 | Shimanckas . | |
| 3,919,964 | * | 11/1975 | Hagen | 440/75 |
| 4,173,939 | * | 11/1979 | Strang | 440/75 |
| 4,793,773 | | 12/1988 | Kinouchi et al. . | |
| 5,030,149 | | 7/1991 | Fujita . | |
| 5,230,644 | | 7/1993 | Meisenburg et al. . | |
| 5,249,995 | | 10/1993 | Meisenburg et al. . | |
| 5,328,396 | | 7/1994 | Hayasaka . | |
| 5,352,141 | | 10/1994 | Shields et al. . | |
| 5,366,398 | | 11/1994 | Meisenburg et al. . | |
| 5,376,031 | | 12/1994 | Meisenburg et al. . | |

(List continued on next page.)

*Primary Examiner*—Sherman Basinger
(74) *Attorney, Agent, or Firm*—Andrus, Sceales, Starke & Sawall, LLP

(57) ABSTRACT

An improved hydraulic system for a twin propeller marine propulsion unit. A vertical drive shaft is operably connected to the engine of the propulsion unit and carries a pinion that drives a pair of coaxial bevel gears. An inner propeller shaft and an outer propeller shaft are mounted concentrically in the lower torpedo section of the gear case and each propeller shaft carries a propeller. To provide forward movement for the watercraft, a sliding clutch is moved in one direction to operably connect the first of the bevel gears with the inner propeller shaft to drive the rear propeller. A hydraulically operated multi-disc clutch is actuated when engine speed reaches a pre-selected elevated value to operably connect the second of the bevel gears to the outer propeller shaft, to thereby drive the second propeller in the opposite direction. The hydraulic system for actuating the multi-disc clutch includes a pump connected to the inner propeller shaft, and the pump has an inlet communicating with a fluid reservoir in the gear case and has an outlet which is connected through a hydraulic line to the multi-disc clutch. A strainer, a pressure regulator and a valve mechanism are disposed in the lower gear case and are located in series in the hydraulic line. At idle and slow operating speeds the valve is held by a solenoid in a position where the fluid is dumped to the reservoir, so that the pressure of the fluid being directed to the multi-disc clutch is insufficient to engage the clutch. At engine speeds above a preselected value, the solenoid is deenergized and the valve is then biased to a position where the fluid is delivered to the multi-disc clutch to engage the clutch and cause operation of the second propeller.

20 Claims, 10 Drawing Sheets

U.S. PATENT DOCUMENTS

| | | | |
|---|---|---|---|
| 5,403,218 | | 4/1995 | Onoue et al. . |
| 5,449,306 | | 9/1995 | Nakayasu et al. . |
| 5,514,014 | | 5/1996 | Ogino et al. . |
| 5,520,559 | | 5/1996 | Nakayasu et al. . |
| 5,522,703 | | 6/1996 | Okamoto . |
| 5,529,520 | | 6/1996 | Iwashita et al. . |
| 5,766,047 | | 6/1998 | Alexander . |
| 5,791,951 | | 8/1998 | Staerzl . |
| 6,062,926 | * | 5/2000 | Alexander, Jr. et al. ..... 440/75 |

* cited by examiner 3
110
109
106
112
96
93
95
81
91
92
107
85
97
87
82
98
89
83
93
96
108
95
107

MARINE PROPULSION UNIT WITH HYDRAULIC PUMP

CROSS REFERENCE TO RELATED APPLICATIONS

This application is a continuation of U.S. application Ser. No. 08/904,072, filed Jul. 31, 1997, now U.S. Pat. No. 6,062,926 which is a continuation-in-part of U.S. application Ser. No. 08/719,633, filed Sep. 25, 1996, now U.S. Pat. No. 5,766,047.

BACKGROUND OF THE INVENTION

Certain marine propulsion units, such as outboard drives and inboard/outboard stern drives, utilize a forward-neutral-reverse transmission along with twin propellers. The typical twin propeller system includes a vertical drive shaft which is operably connected to the engine and is journaled for rotation in the lower gearcase. The lower end of the drive shaft carries a pinion which drives a pair of coaxial bevel gears that are located in the lower torpedo-shaped section of the gearcase. Inner and outer propeller shafts are mounted concentrically in the lower section and each propeller shaft carries a propeller, with the propeller of the outer shaft being located forwardly of the propeller of the inner shaft.

U.S. Pat. No. 4,793,773 is directed to a twin propeller propulsion system in which both propellers are rotated at the same speed, but in opposite directions, during forward movement of the watercraft. With this system, a mechanism is provided to disconnect the outer propeller shaft when the watercraft is moved in the reverse direction. Thus, with the system shown in the aforementioned patent, both propellers are operated during forward movement of the watercraft, but only the inner propeller shaft and the rear propeller are operated during reverse movement.

Co-pending U.S. Pat. application Ser. No. 08/719,633, filed Sep. 25, 1996, now U.S. Pat. No. 5,766,047 is directed to a twin propeller marine propulsion system in which, during forward movement of the watercraft, only one of the propellers is driven at low engine speed and the second propeller is driven when the engine speed reaches a pre-selected elevated value.

In accordance with the construction of the aforementioned patent application, a sliding clutch mechanism having forward neutral and reverse positions is employed to selectively engage the inner propeller shaft with the bevel gears to thereby rotate the inner propeller shaft and the rear propeller in both the forward and reverse directions. In addition, a hydraulically operated multiple disc clutch located in the lower torpedo section is employed to selectively cause engagement of one of the bevel gears with the outer propeller shaft when the engine speed reaches a pre-selected elevated value, normally in the range of 3,500 rpm to 7,000 rpm, to thereby cause the second or forward propeller to rotate in the opposite direction from the rear propeller. With this construction, only the rear propeller is driven at low forward speeds, while at high forward speeds both propellers are driven.

As described in the aforementioned patent application, the multiple disc clutch is moved to the engaged position at the pre-selected elevated engine speed by supplying pressurized fluid to a piston which engages the multiple clutch discs and moves the discs to a contacting or driving position. With this construction, only a single propeller is operable at low speeds, and once the pre-selected elevated engine speed has been achieved, the second propeller is then driven, resulting in a significant improvement in acceleration of the watercraft when getting on plane.

SUMMARY OF THE INVENTION

The invention is directed to an improved hydraulic system for a twin propeller marine propulsion unit of the type described in pending U.S. patent application, Ser. No. 08/719,633, filed Sep. 25, 1996 now U.S. Pat. No. 5,766,047.

The propulsion unit includes a vertical drive shaft that is journaled in the lower gearcase. The lower end of the drive shaft carries a beveled pinion gear that drives a pair of coaxial annular bevel gears located in the lower torpedo section of the gearcase. Inner and outer propeller shafts are journaled concentrically within the torpedo section and each propeller shaft carries a propeller with the propeller on the inner shaft being located to the rear of the propeller on the outer shaft.

A sliding clutch mechanism having forward, neutral and reverse positions is employed to selectively engage the inner propeller shaft with the bevel gears to thereby rotate the inner propeller shaft and the rear propeller in both forward and reverse directions. In addition, a hydraulically operated multiple disc clutch located in the lower torpedo section is employed to selectively cause engagement of one of the bevel gears with the outer propeller shaft when the engine reaches a pre-selected elevated value normally in the range of about 3,500 rpm to 7,000 rpm, to thereby cause the second or forward propeller to rotate in the opposite direction from the rear propeller. Thus, at low forward speeds only the rear propeller is driven, while at high forward speeds, both propellers are driven.

In accordance with the invention, an improved hydraulic system located within the gearcase is employed to supply pressurized fluid to a piston which acts to engage the multiple disc clutch and move the clutch to a contacting or driving position. The hydraulic fluid is pressurized through operation of a pump that is operably connected to the inner propeller shaft, so that rotation of the inner propeller shaft in the forward direction of watercraft movement will drive the pump to pressurize the fluid. The inlet to the pump communicates with a fluid reservoir or sump which is located in the gearcase, while the outlet of the pump is connected through a hydraulic line or conduit to the piston of the multiple disc clutch. As a feature of the invention, a strainer, pressure regulator, and valve mechanism are mounted within the gearcase and are located in series in the hydraulic line.

The strainer includes a generally cylindrical screen element which serves to filter out foreign particles in the hydraulic fluid. In addition, the strainer incorporates a provision for by-passing the fluid around the screen element when there is a substantial pressure drop across the screen element which can occur at low ambient temperatures or if the screen element is clogged.

The pressure regulator, which is located downstream from the strainer, includes a generally cylindrical casing which houses a plunger having a flat face which is exposed to the pressure of the fluid in the hydraulic line. On an increase in pressure in the fluid above a pre-selected value, the plunger will be moved outwardly against a spring biasing force to expose an outlet in the casing, thereby diverting fluid to the sump or reservoir in the gearcase.

The valve mechanism, which is located downstream of the pressure regulator, includes a valve body which is preferably formed integrally with the casing of the pressure regulator. The valve mechanism includes a solenoid operated valve member. At idle or low engine speed, the valve member is held in a dumping position by the energized solenoid so that the fluid is dumped to the reservoir and the pressure of the fluid being supplied to the piston of the multi-disc clutch is insufficient to actuate the piston and engage the clutch. When the engine speed increases to a preselected elevated value, a conventional engine speed sensor acts to deenergize the solenoid, and the valve member will then be biased to a second or clutching position where the fluid will be delivered to the piston of the multi-disc clutch to cause engagement of the clutch and thus effect operation of the outer propeller shaft and its propeller.

As a feature of the invention, a pair of concentrically mounted springs interconnect the valve member and the valve body. A first of the springs has a substantially lesser force than the second spring and the first spring acts to urge the valve to the clutching position. When the valve member is moved toward the dumping position by operation of the solenoid, the initial movement of the solenoid plunger will compress the lighter spring and further movement of the plunger will cause compression of the heavier spring. The use of the two springs results in the combined spring force throughout the stroke of the solenoid plunger being a substantial portion of the force of the solenoid throughout the stroke of the solenoid plunger, so that the clutch will be actuated with a minimum time lag.

The invention provides a compact unit with the strainer, pressure regulator and valve mechanism being contained within the lower unit of the outboard or stern drive.

The system effectively filters foreign particles from the hydraulic fluid and yet permits by-pass of the screen element when a predetermined pressure drop occurs across the screen element, such as for example, when the hydraulic fluid is at a low temperature causing the fluid to be very viscous, or in case the screen becomes clogged. The pressure regulator provides a substantially uniform pressure for the fluid being delivered to the clutch when the valve is in the clutching position. The system is designed without need for a shut-off valve to the clutch when the valve is in the dumping position, thus permitting use of a less expensive valve structure.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
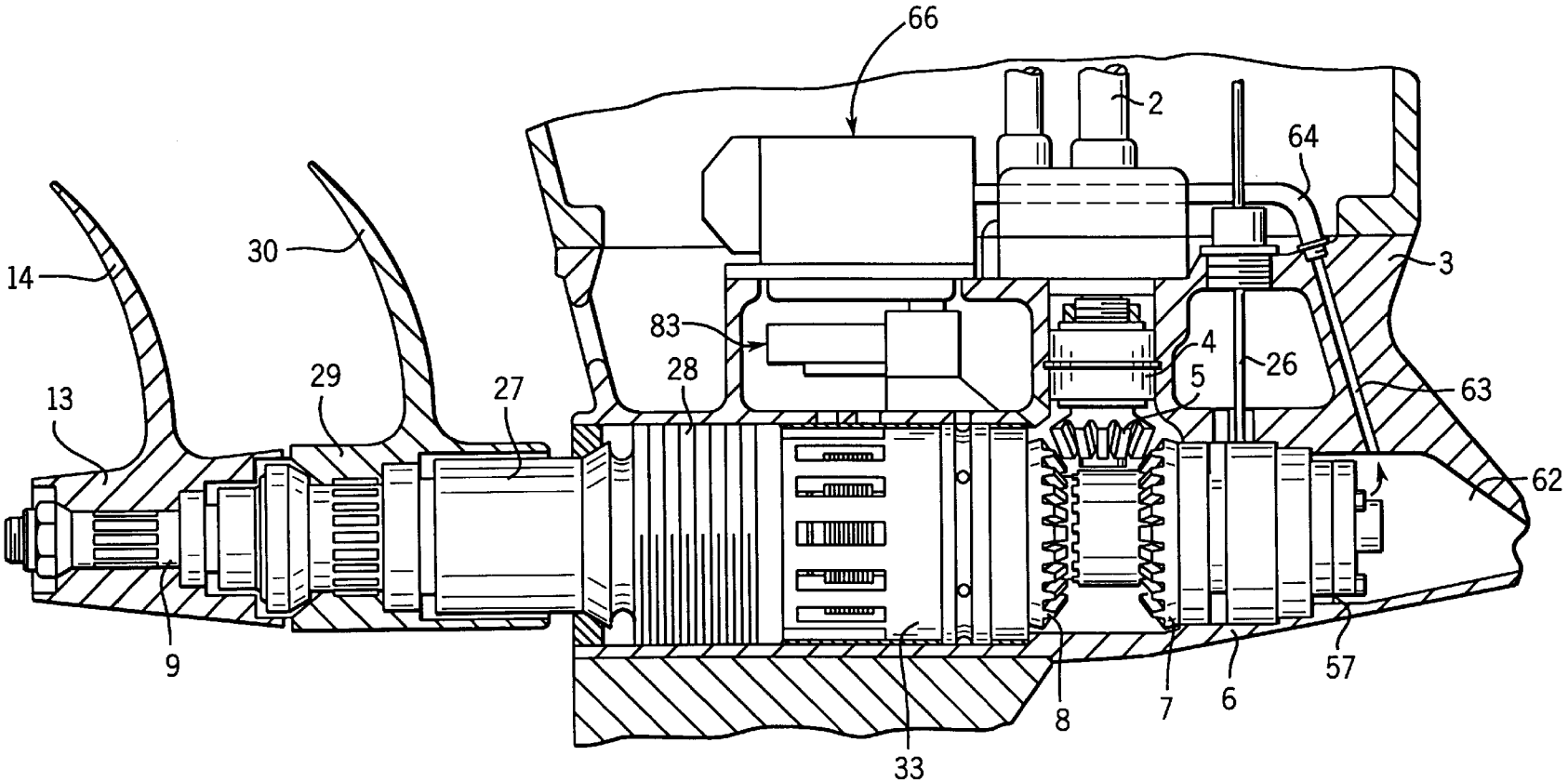
FIG. 1 is a longitudinal section of the lower drive unit of an outboard marine drive incorporating the invention.

FIG. 1 shows a twin propeller marine outboard engine 1 for a boat or watercraft that incorporates the invention. The drive mechanism for driving the twin propellers of the outboard engine 1 is the same as that described in copending U.S. application Ser. No. 08,719,633, filed Sep. 25, 1996, now U.S. Pat. No. 5,766,047, and the description of that patent application is incorporated herein by reference. It is contemplated that the invention can also be utilized with an inboard/outboard stern drive, or other marine drive.

Outboard engine 1 includes a vertical drive shaft 2 which is journaled for rotation in gear case 3 by a bearing assembly 4. The lower end of drive shaft 2 carries a bevel pinion gear 5 that is located within the lower torpedo-shaped section 6 of the gearcase.

Figure 2:
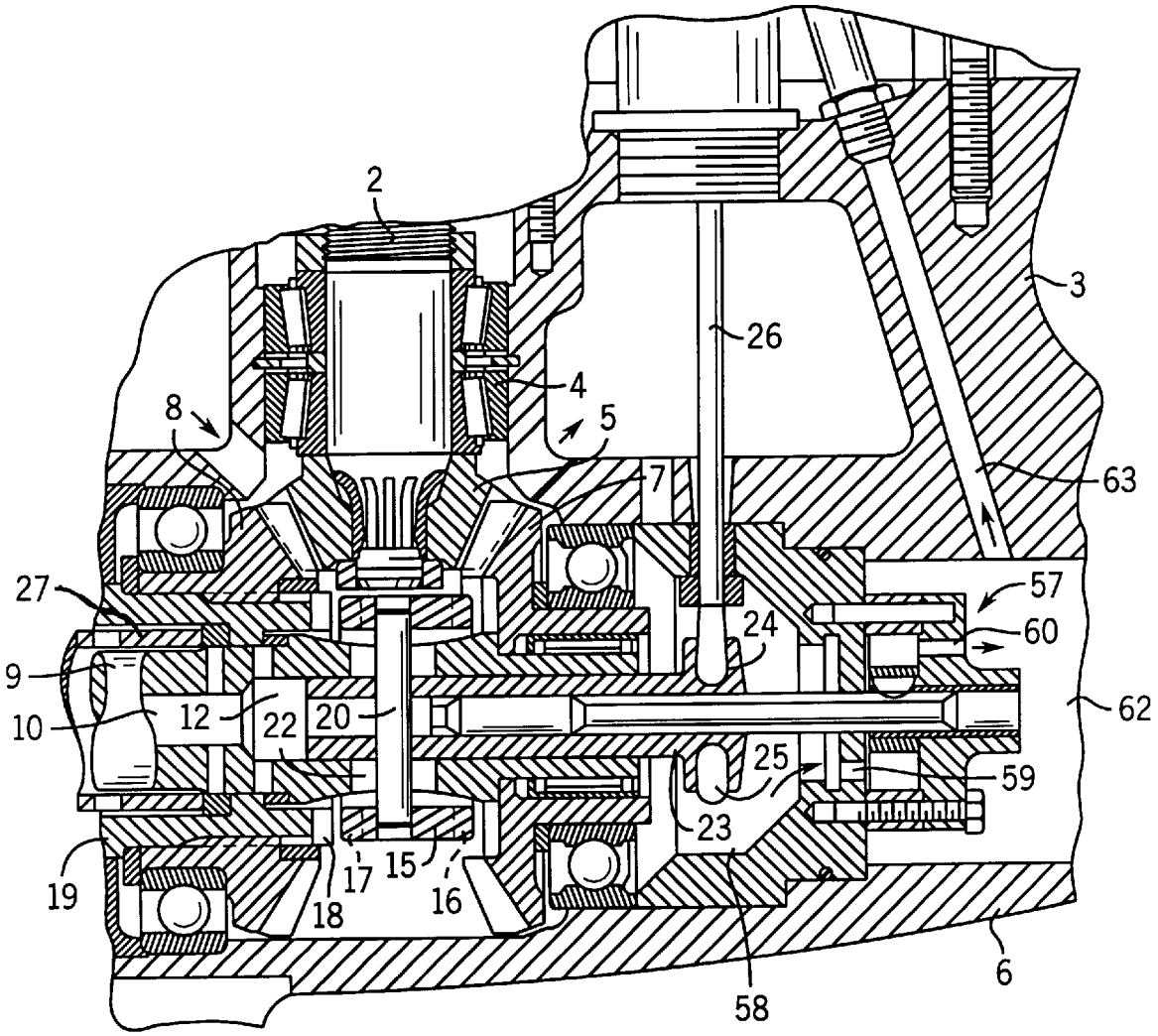
FIG. 2 is an enlarged fragmentary section showing the forward portion of the drive mechanism.

Pinion gear 5 drives a pair of coaxial, annular bevel gears 7 and 8. As best shown in FIG. 2, an inner propeller shaft 9 extends through aligned openings in bevel bears 7 and 8 and the forward end of shaft 9 is journaled within the hub of bevel gear 7 by a suitable bearing assembly. The central portion of inner propeller shaft 9 is provided with an axial passage 10 which merges into an enlarged forward passage 12.

Secured to the rear end of propeller shaft 9 is a hub 13 of a propeller 14, and propeller 14 includes a plurality of blades which are located at a rearward rake angle, preferably in the range of 20° to 30°.

An annular sliding clutch 15 is located within torpedo section 6 and includes a series of forwardly facing teeth 16 which are adapted to engage teeth on bevel gear 7. Clutch 15 is also formed with a series of rearwardly facing teeth 17 adapted to engage teeth 18 on the forward end of a clutch housing 19 that is threaded to the hub portion of bevel gear 8 and rotates with the bevel gear. Clutch 15 can be moved between three positions, namely a central or neutral position, a forward position where teeth 16 engage the teeth on bevel gear 7, and a rearward position in which the teeth 17 engage the teeth 18 of housing 19.

To move clutch 15 between the three positions, a pin 20 extends diametrically across the clutch and extends through elongated slots 22 formed in the inner propeller shaft 9. Pin 20 also extends through a pair of aligned holes in a sleeve 23 that is mounted in the forward passage 12 of inner propeller shaft 9. As shown in FIG. 2, the forward end of sleeve 23 is enlarged and is provided with a circumferential groove 24 which receives a crank 25 mounted on the lower end of actuating rod 26. Rotation of rod 26 will pivot crank 25 to thereby move sleeve 23 axially, and thus move clutch 15 between the neutral, forward and reverse positions. When clutch 15 is moved forwardly to engage teeth 16 with the teeth on bevel gear 7, the clutch will rotate with bevel gear 7 and impart rotation to the inner propeller shaft 9 to drive the propeller 14.

An outer propeller shaft 27 is mounted concentrically around the inner propeller shaft. To provide support for the propeller shafts 9 and 27, an annular bearing carrier 28 is threaded on the rear end of torpedo section 6, and is positioned between the outer propeller shaft 27 and the torpedo section 6, as described in detail in the aforementioned patent application. A hub 29 of propeller 30 is secured to the outer propeller shaft 27, and propeller 30 is located forwardly of propeller 14.

The hub portion 32 of housing 19 is threaded to bevel gear 8 and rotates with the bevel gear. Housing 19 also includes an enlarged rear portion 33 that houses a multiple disc clutch 34. Clutch 34, when engaged, functions to connect the housing 19 with the outer propeller shaft 27, to thereby drive propeller 30.

Clutch 34, as described in detail in the aforementioned patent application, includes a series of clutch discs 35 each having a plurality of circumferentially spaced, outwardly extending ears or lugs 36, which are engaged with slots 37 formed in the rear portion 33 of housing 19. A second group of generally flat clutch discs 38 are interdigitated with discs 35 and opposite faces of the discs 38 are provided with a friction coating. Discs 38 are connected to outer propeller shaft 27 through a splined connection.

Discs 35 and 38 are contained within the enlarged rear portion 33 of housing 19 by a pressure plate 40 having circumferentially spaced peripheral ears or lugs that engage the slots 37 in housing portion 33. The cap is retained in position by a suitable snap ring 42.

Spaced outwardly of section 33 of housing 19 is a cylindrical metal sleeve 43 having a longitudinal slot 44 which registers with a series of holes 45 in gearcase 3. Holes 45 communicate with a sump or reservoir 46 formed in the gearcase. Oil or hydraulic fluid can flow between reservoir 46 and torpedo section 6 through holes 45 and slot 44. In addition, holes 45a also provide communication between the reservoir 46 and the interior of torpedo section 6.

Figure 13:
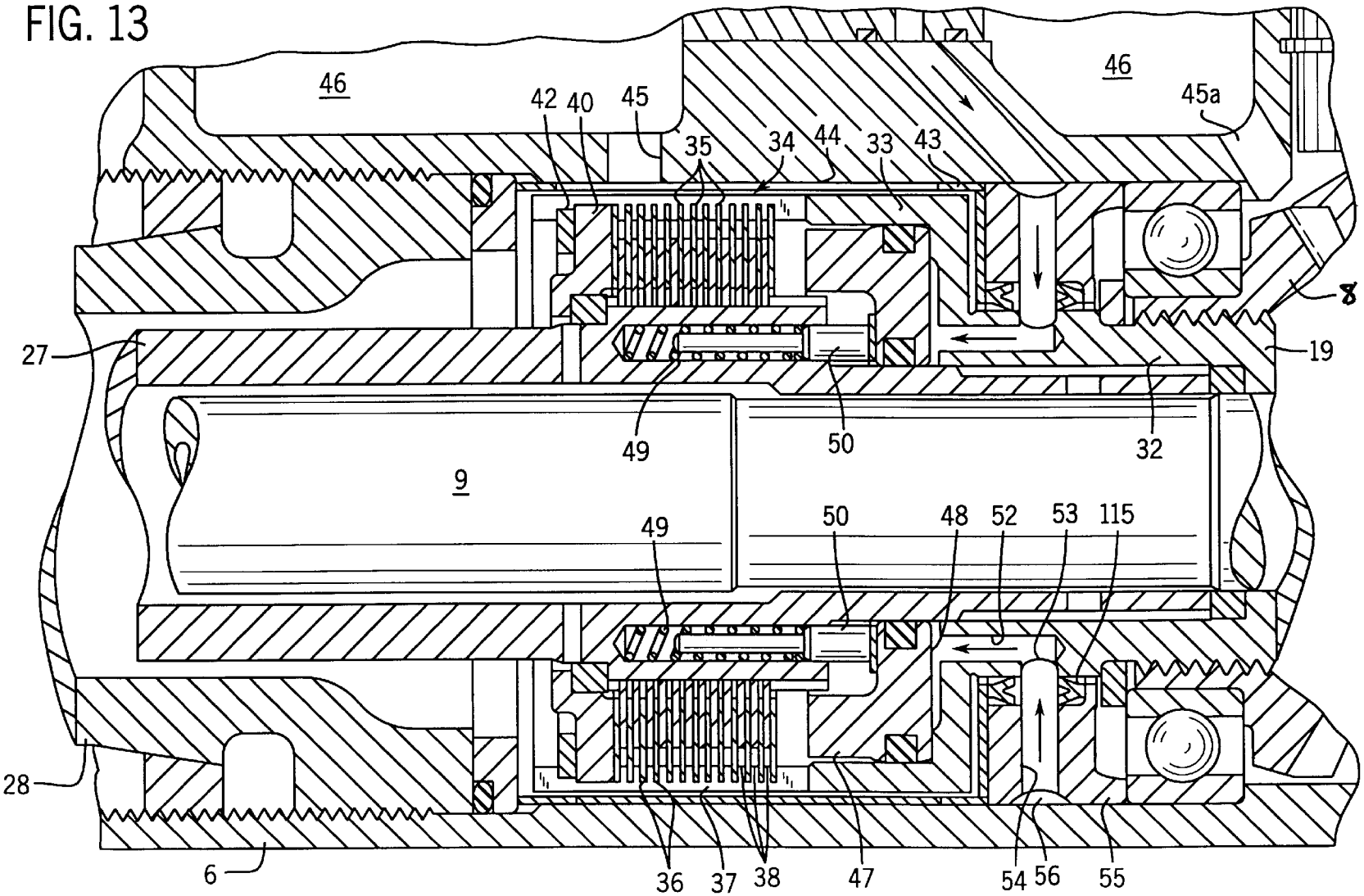
FIG. 13 is an enlarged fragmentary longitudinal section showing the multidisc clutch construction.

Clutch discs 35 and 38 are moved into driving engagement by an annular piston 47 which is mounted in the rear section 33 of housing 19. Piston 47 has a rear face which is adapted to engage the discs 35 and 38 and is also provided with a generally flat forward face 48. The piston is urged forwardly by a series of springs 49, each of which is mounted in a longitudinal hole in outer propeller shaft 27. The rear end of each spring 49 engages the bottom of a hole, while the forward end of each spring bears against a shoulder on pin 50 which, in turn, bears against the piston 47. Thus, the force of springs 49 urge the piston 47 forwardly. In this position, the peripheral edge of forward face 48 will engage a shoulder on housing 19, as best seen in FIG. 13 to space the face 48 away from the bottom of housing 19.

Piston 47 is adapted to be moved rearwardly to engage clutch discs 35 and 38 by pressurized hydraulic fluid or oil. The rotating housing 19 is provided with a series of axial holes 52 which communicate with the space between piston face 48 and the bottom of housing 19. The forward ends of holes 52 connect with an annular groove 53 formed in the outer surface of hub portion 32 of housing 19, and grooves 53, in turn, communicate with radial holes 54 in ring 55. Ring 55 is fixed to gear case 3 and the outer ends of radial holes 54 communicate with a circumferential groove 56, which receives the pressurized hydraulic fluid as will be described in greater detail.

Figure 3:
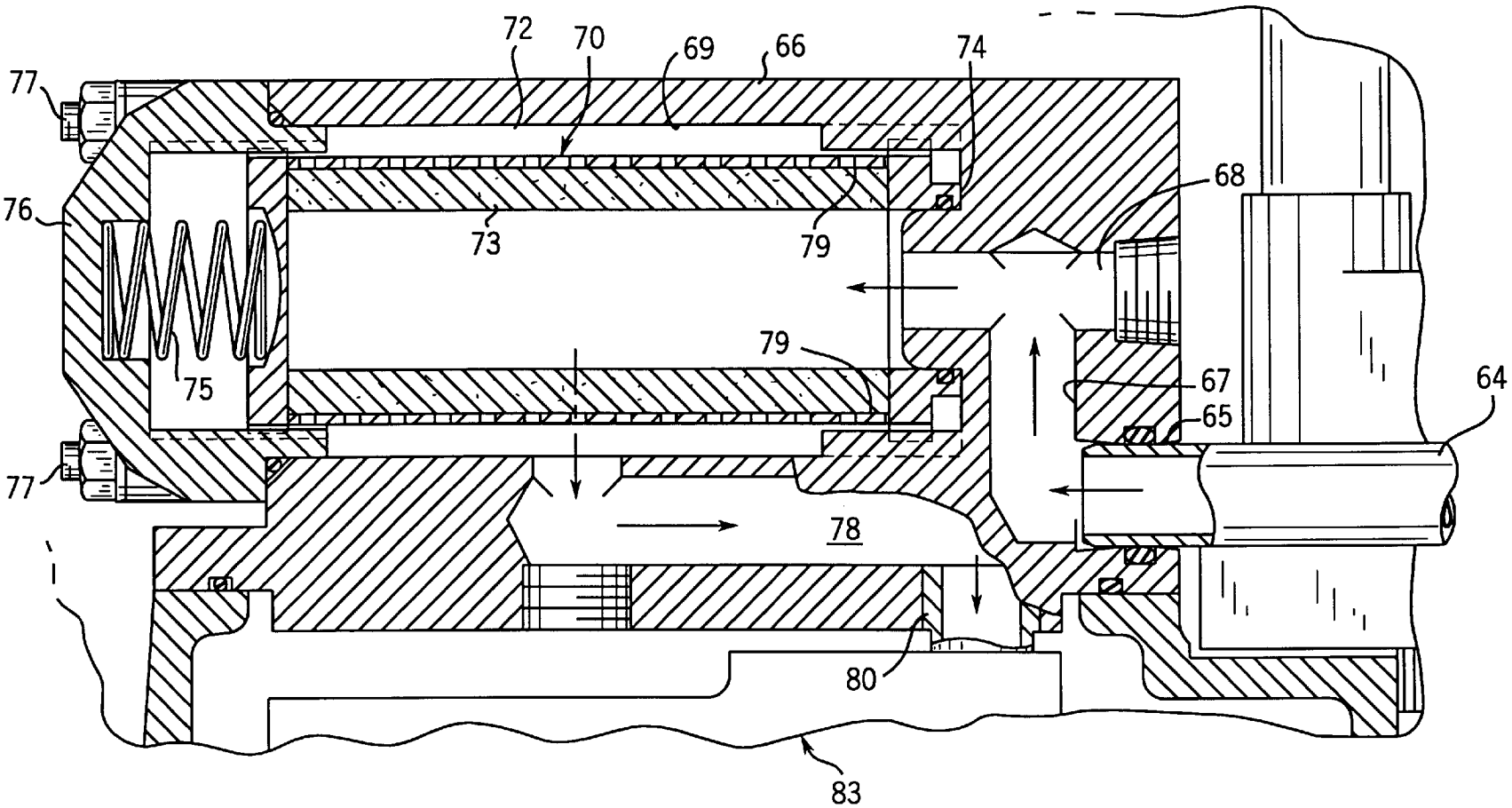
FIG. 3 is a longitudinal section of the strainer unit with the screen element being shown in the screening position.

The hydraulic system of the invention includes a pump 57, as shown in FIG. 2, which is operably connected to inner propeller shaft 9 and rotates with the shaft. Pump 57 can be constructed as described in the aforementioned patent application Ser. No. 08/719,633, now U.S. Pat. No. 5,766,047. Chamber 58 located at the forward portion of torpedo section 6 of the gearcase is normally filled with oil and during operation of pump 57 oil will be drawn from chamber 58 through inlet 59 to the pump and fluid will be discharged from the pump through outlet 60 to the forward chamber 62. The hydraulic fluid will then flow through passage 63 in gearcase 3 to hydraulic line or conduit 64. Hydraulic line 64 is connected to the inlet 65 of a strainer or filter casing 66, which is located within gearcase 3. Inlet 65 communicates with the lower end of a vertical passage 67 which, in turn, is connected to a horizontal passage 68 that leads to a central chamber 69 in casing 66, as best seen in FIG. 3.

Mounted within chamber 69 is a generally cup-shaped screen element 70 which includes an outer cylindrical perforated metal member 72, and an inner cylindrical screen or mesh 73, preferably formed of stainless steel. In the normal screening position, the open end of screen element 70 is biased against the bottom of an annular recess 74 formed in casing 66 by a coil spring 75 which is interposed between the closed end of the screen element and a cap 76 which is secured to the open end of casing 66 by bolts 77. In the screening position the hydraulic fluid enters the hollow interior of screen element 70 through passage 68 and flows radially outward through the screen element to outlet 78 in casing 66.

Figure 4:
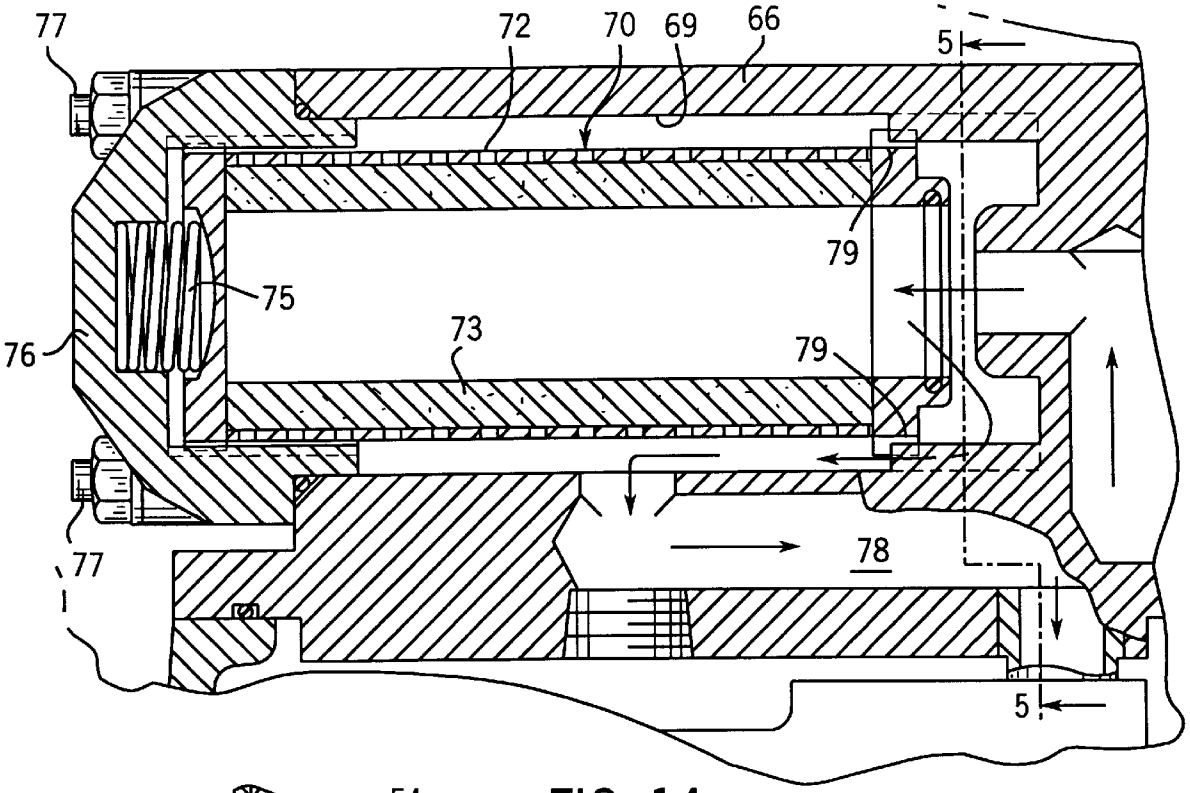
FIG. 4 is a view similar to FIG. 3 with the screen element being shown in the by-pass position.
Figure 5:
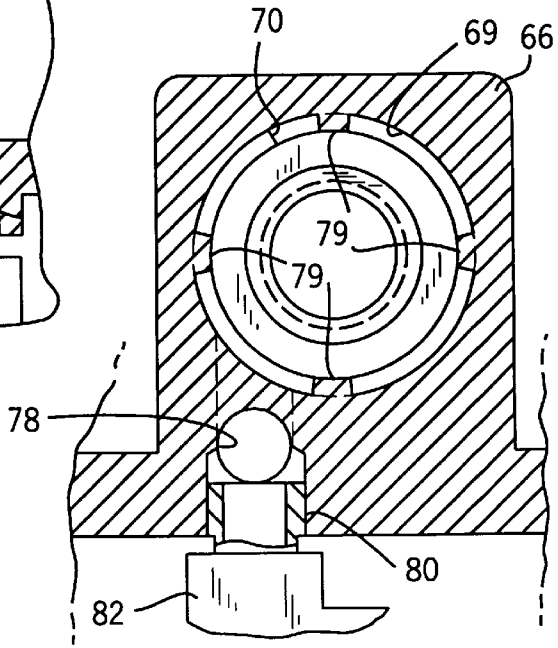
FIG. 5 is a section taken along line 5—5 of FIG. 4.

The screening system also includes a provision to bypass the screen element 70 in the event there is a substantial pressure differential between the interior and exterior of the screen element as could occur if the screen element is clogged, or if the hydraulic fluid is at a low temperature and is very viscous. If the pressure differential exceeds a preselected value, the internal pressure in screen element 70 will move the filter element axially against the force of the spring 75 to a bypass position, as shown in FIG. 4. The inner wall of casing 66 is provided with a series of longitudinal grooves or splines 79, and when the end of the screen element 70 is unseated from the recess 74, the fluid will pass through the grooves or splines 79 to the outlet 78, thus bypassing the screen element 70. If the pressure differential resulting in the bypass is caused by low temperature oil, the heating of the oil through operation of the engine will reduce the pressure differential, causing the screen element 70 to move to the right, as shown in FIG. 3, to close off the bypass.

The hydraulic fluid is not only employed to operate to the multi-disc clutch 34, but is also used to lubricate the various operating or moving elements contained within torpedo section 6. As the valve which controls the flow of fluid in the hydraulic system has close tolerances, it is important that any foreign particulate material be removed from the fluid before it passes to the valve and to the clutch 6.

Outlet 78 in the filter or strainer casing 66 is connected by nipple 80 to a passage 81 in the upper surface of a housing 82 of a pressure regulator 83, which is also mounted within the gearcase 3, and is located upstream of a control or dump valve 84.

Figure 7:
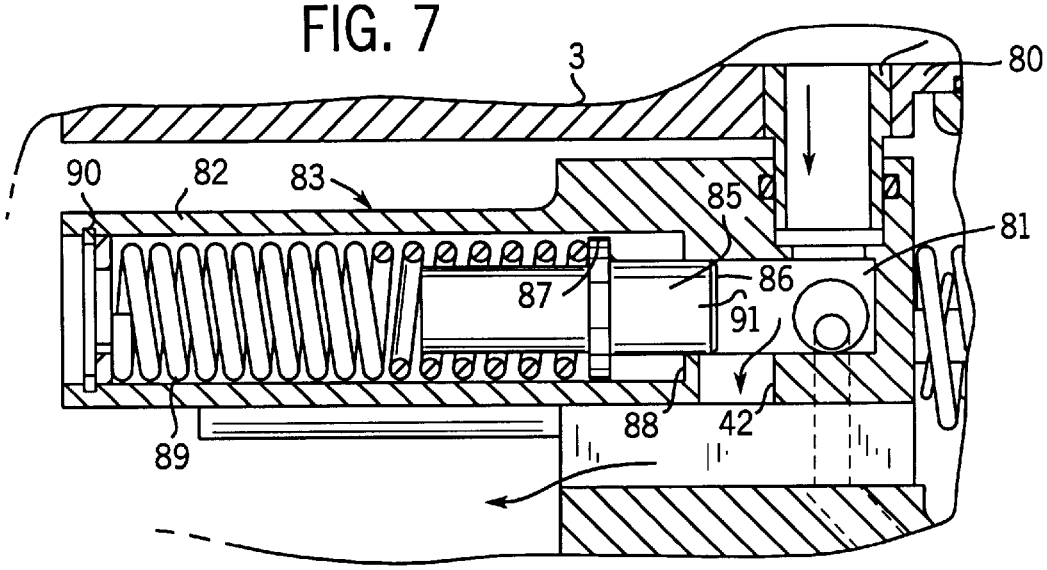
FIG. 7 is a view similar to FIG. 6 with the plunger in a dumping position.

Pressure regulator 83 includes a plunger or slide 85 which is mounted for axial sliding movement in a bore 86 of housing 82. As best shown in FIG. 7, the central portion of plunger 85 is provided with a radially extending flange or collar 87 which is biased against a shoulder 88 formed in the pressure regulator housing 82 by a coil spring 89. The outer end of spring 89 bears against a snap ring 90 which is mounted within a circumferential groove in the inner surface of housing 82. Thus, the force of spring 89 will urge the flange 87 into engagement with shoulder 88 and the inner face 91 of plunger 85 will be exposed to the pressure of the fluid in passage 81.

Pressure regulator housing 82 is also formed with a radial outlet 92 which communicates with bore 86. At idle and slow engine speeds, outlet 92 is normally closed off by plunger 85, as shown in FIG. 7. However, at higher engine speeds when the valve is supplying fluid to the multi-disc clutch, if the pressure of the fluid in passage 81 exceeds a pre-selected value, the pressure will force the plunger 85 axially against the force of spring 89 to thereby expose the outlet 92 and dump fluid to the reservoir 64.

Figure 8:
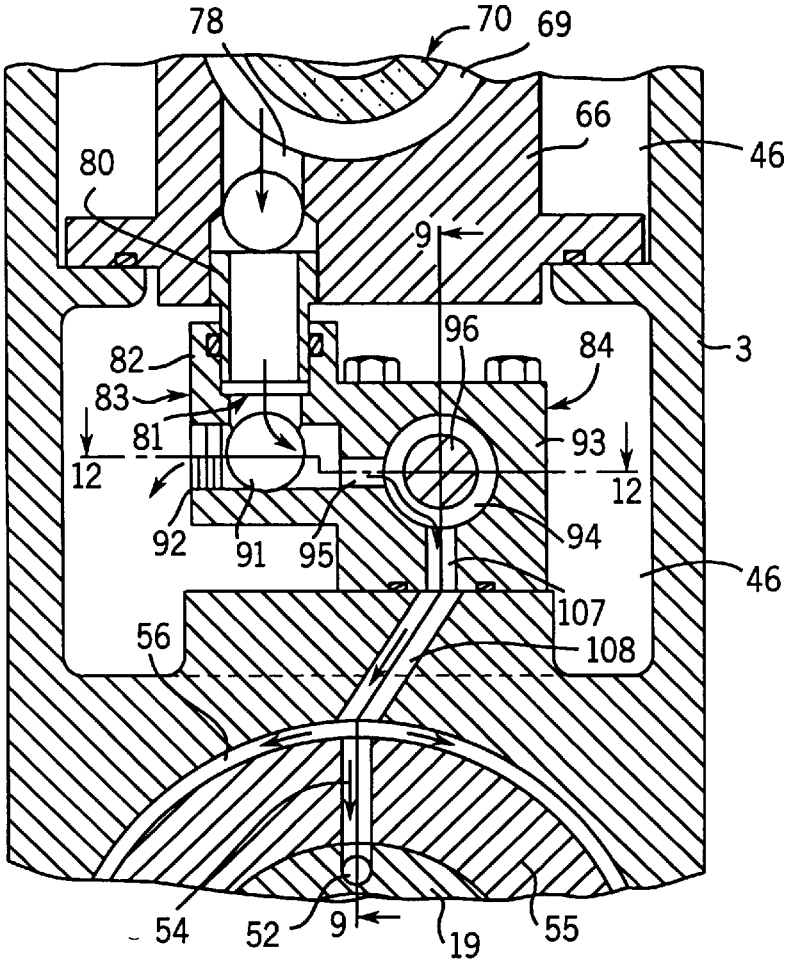
FIG. 8 is a transverse section taken along line 8—8 of FIG. 6.

Valve unit 84 includes a valve body 93, which is formed integrally with housing 82 of pressure regulator 83. Housing 82 and valve body 93 are located in a generally side-by-side relation, as best shown in FIG. 8. Valve body 93 includes a valve chamber 94, and a generally horizontal passage 95 connects passage 81 in pressure regulator housing 82 with valve chamber 94.

A valve 96 is mounted for sliding movement within chamber 94, and is connected to the plunger 97 of a solenoid 98 by a pin 99. To provide the connection, plunger 97 is provided with a bifurcated end 100 which straddles a lug 101 on valve 96 and pin 99 extends through aligned holes in end 100 and the lug 101 to provide the connection.

To mount solenoid 98 on valve body 93, an externally threaded sleeve 102 projects outwardly from the end of the solenoid and surrounds the plunger 97. Sleeve 102 is threaded within a suitable opening in valve body 93, as best shown in FIGS. 9 and 10, thus supporting the solenoid 98 from the valve body 93.

Valve 96 is provided with a generally cylindrical section 103 and an outer section 104 of reduced diameter, which is connected to the cylindrical section 103 by a tapered area 105. A head or cap 106 is secured to the outer end of the valve section 104.

Figure 9:
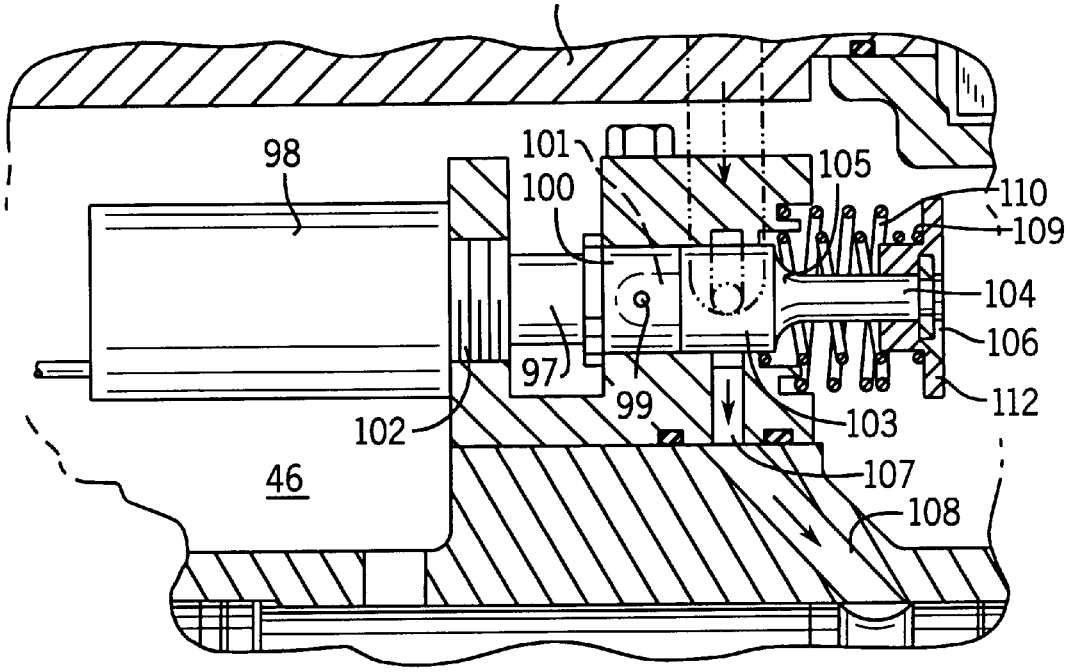
FIG. 9 is a section taken along line 9—9 of of FIG. 8, and showing the valve in the clutching position.
Figure 10:
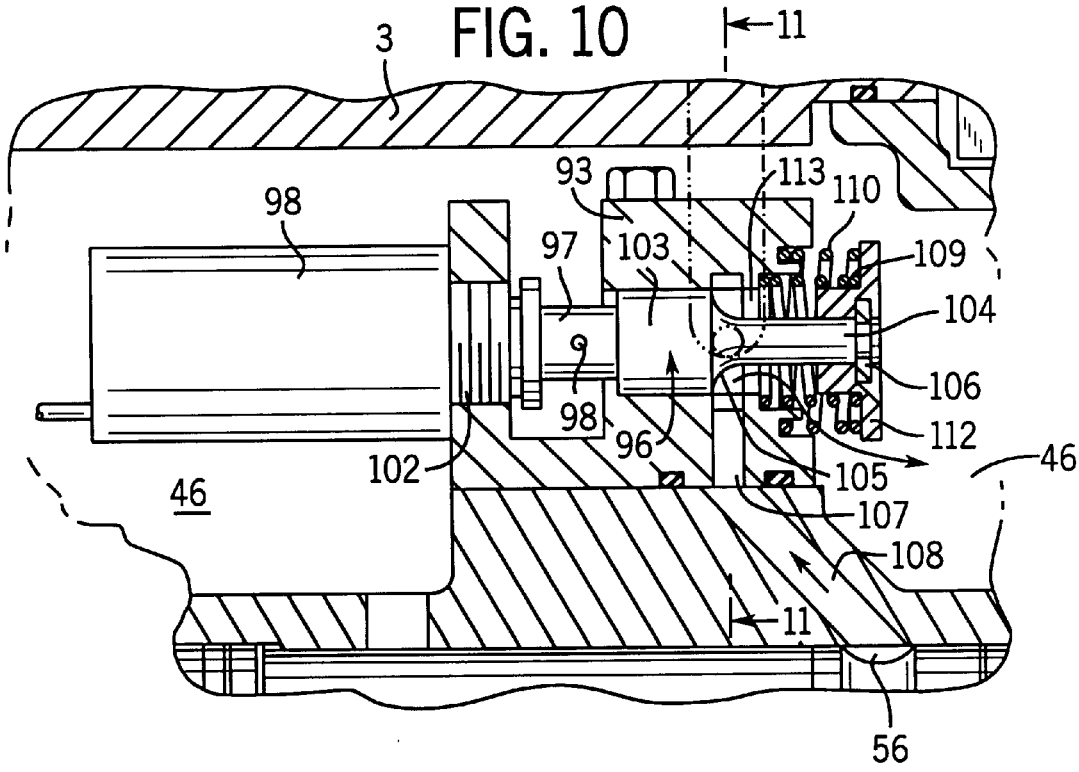
FIG. 10 is a view similar to FIG. 9 and showing the valve in the dumping position.
Figures 11, 12:
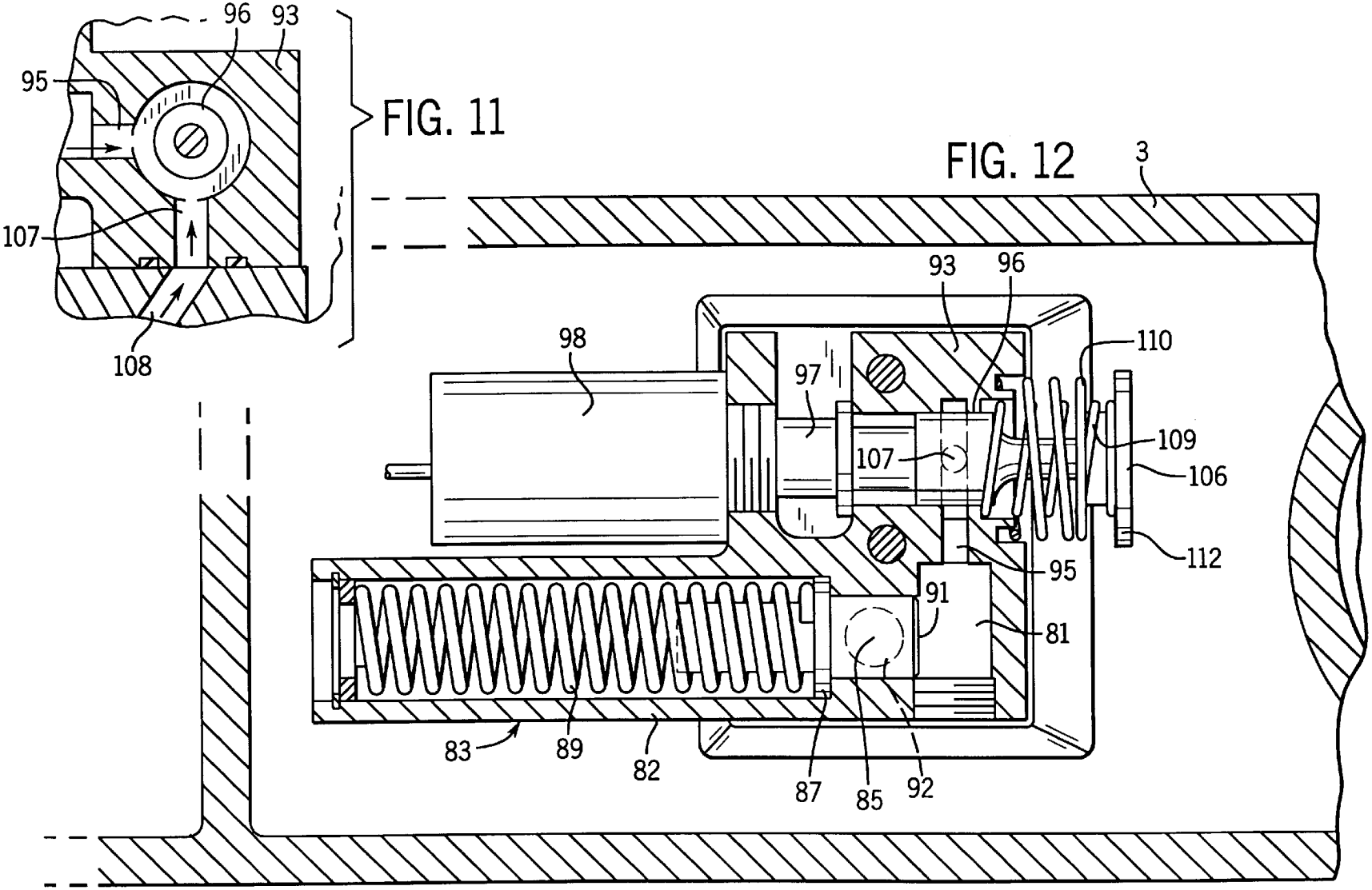
FIG. 11 is a section taken along line 11—11 of FIG. 10.
FIG. 12 is a horizontal section taken along line 12—12 of FIG. 8 and showing the pressure regulator and the valve mechanism.

Valve 96 is biased to a non-dumping or clutching position, as shown in FIG. 9, where the valve will not restrict the flow of pressurized fluid from passage 95, through valve chamber 94 to outlet 107. Outlet 107 is located at 90° from passage 81 and is connected to a diagonal passage 108 in gear case 3. Diagonal passage 108, in turn, communicates with circumferential groove 56, so that in this position of valve 95, pressurized fluid will be supplied through holes 54 and axial passages 52 against the face 48 of piston 47, thus moving the piston against the force of spring 49 to engage the clutch 34. Valve 96 is biased to this position by a coil spring 109 which is interposed between valve body 93 and head 106 of the valve. With this construction, the force of spring 109 will urge the valve 96 to the position shown in FIG. 9 to effect engagement of clutch 34. The pressure regulator 83 comes into play when the valve 96 is in the clutching position, serving to dump fluid through outlet 92 to reservoir 46 when the fluid pressure exceeds a preselected value.

As a feature of the invention, a second coil spring 110 is located concentrically around the spring 109 and the inner end of spring 110 is seated within an annular recess in valve body 93. When the valve 96 is in the position as shown in FIG. 9, the outer end of spring 110 will be spaced from an annular flange 112 on head 106. In the preferred form of the invention, spring 110 has a greater spring force than spring 109.

With solenoid 98 deenergized, the low rate spring 109 will urge valve 96 to the position shown in FIG. 9 to permit the hydraulic fluid to pass through the valve body 93 to the passage 108 and hence to the piston 47 of multi-disc clutch 34 to engage the clutch. When the solenoid is energized, plunger 97 will be drawn inwardly, thus compressing spring 109. Continued inward movement of solenoid plunger 97 will bring the flange 112 of head 106 into contact with the high rate spring 110, compressing the spring 110, so that at this stage the force of both springs will oppose the force of the solenoid. With plunger 97 fully retracted, valve 96 will be in the position shown in FIG. 10, in which the tapered section 105 of the valve will be aligned with the fluid passage in the valve body. In this position of the valve, the fluid will be dumped through the annular gap 113 between valve section 104 and the valve body to the reservoir 46. Thus, the pressure of the fluid in outlet 107 will be insufficient to move piston 47 against the force of springs 49, so that the clutch 34 will remain disengaged.

Figure 15:
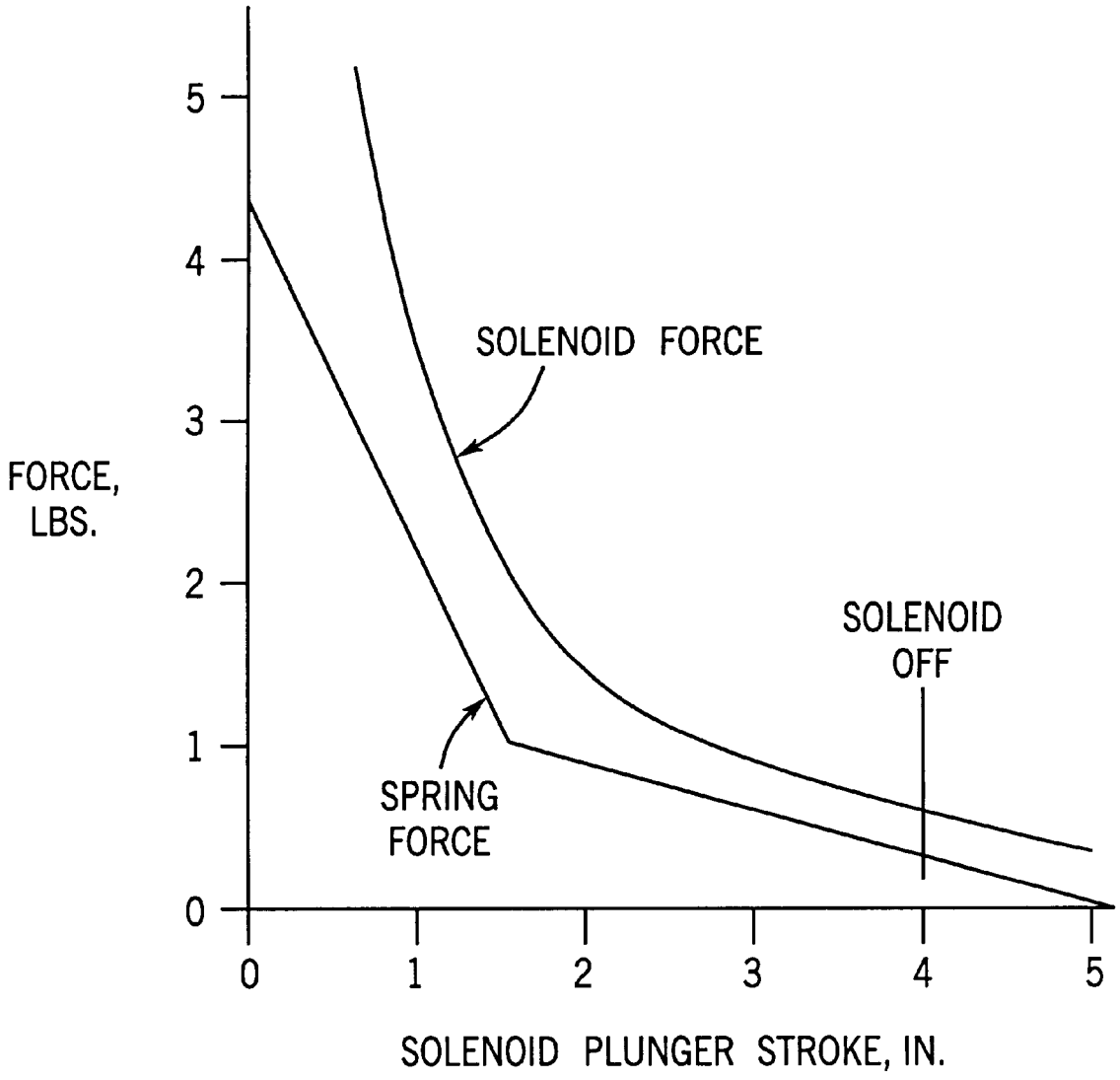
FIG. 15 is a graph showing the combined spring force acting on the valve as compared to the solenoid force.

The use of the two springs 109 and 110 with different spring rates, enables the combined spring rate to be a substantial portion of the force of the solenoid throughout the stroke of the solenoid plunger. FIG. 15 includes a curve showing the solenoid force in lbs. versus the stroke in inches of the solenoid plunger. The solenoid force is low on initial retraction of the plunger and then increases dramatically as the plunger moves to its fully retracted position. FIG. 15 also includes a curve illustrating the combined force of springs 109 and 110 during movement of the solenoid plunger. The spring force acting against the valve will be relatively low on initial retraction of the solenoid plunger due to the fact that only the low rate spring 109 is acting on the valve. When the head 106 of the valve engages the high rate spring 110, the combined force of the two springs will be relatively high and will, in general, follow the solenoid force. By approximating the spring force to the solenoid force, clutch 34 will be actuated with a minimum time lag, and this provides better control over the clutching in of the second propeller mounted on the outer propeller shaft.

Figure 14:
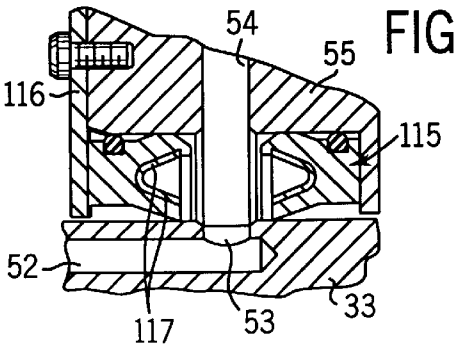
FIG. 14 is an enlarged fragmentary section of the seal between the valve body and the clutch housing.
Figure 6:
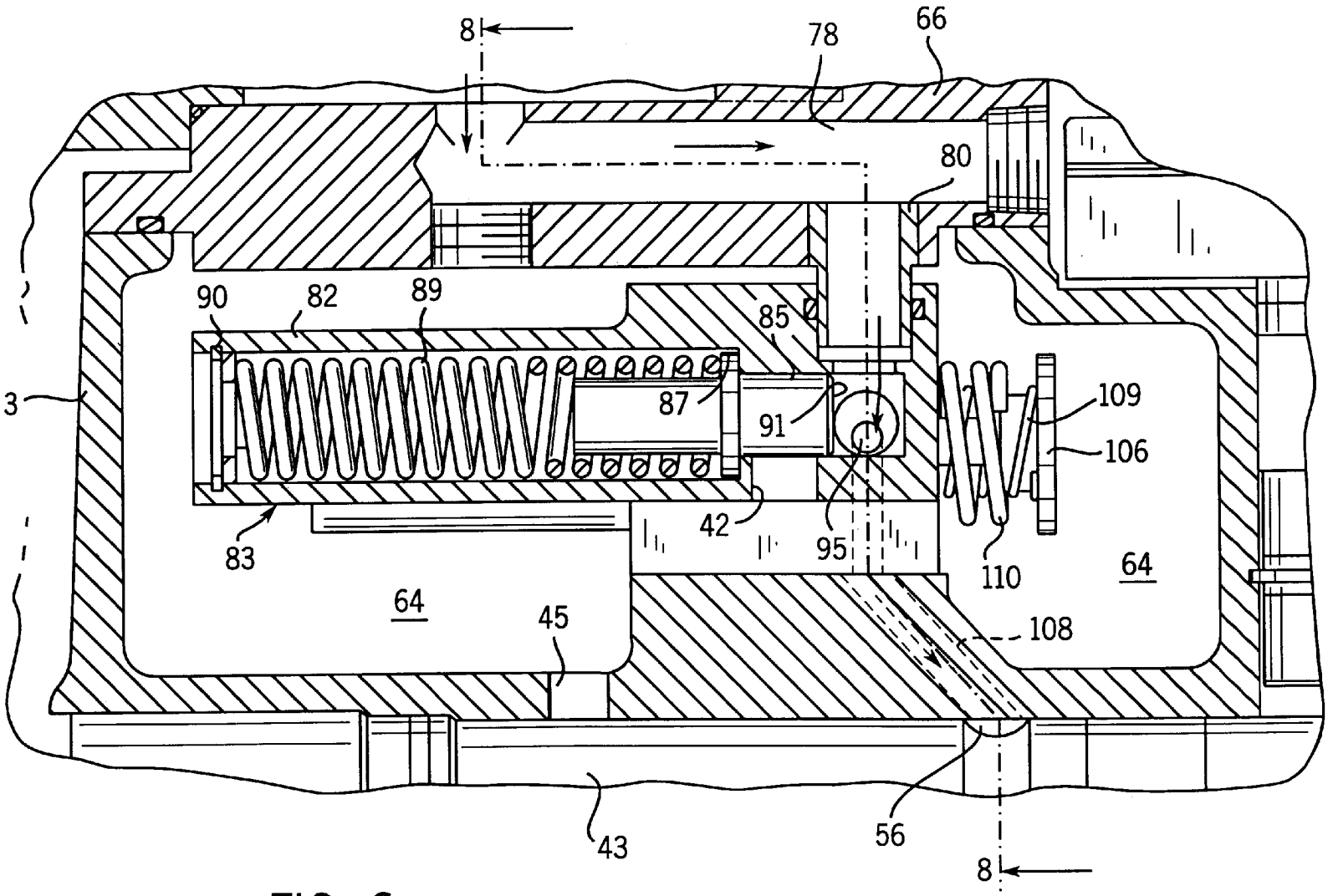
FIG. 6 is a longitudinal section of the pressure regulator with the plunger of the pressure regulator being in the non-dumping position.

To prevent leakage of fluid at the joint between the fixed ring 55 and the rotating clutch housing 19, a flexible lip-type seal 115 is mounted in a recess in the inner diameter of ring 55 and is held in the recess by plate 116 that is secured to a face of ring 55, as shown in FIG. 14. Seal 115 is provided with a pair of diverging flexible lips 117 and the pressure of the fluid in passage 54 will tend to force the lips apart, urging the inner lip into tight engagement with the hub 32 of rotating clutch housing 19 to prevent leakage at the joint between ring 55 and housing 33.

In operation, the watercraft or boat is moved forwardly by rotating the rod 26, causing crank 25 to move sleeve 23 and clutch 15 forwardly to cause engagement of the clutch teeth 16 with the teeth on bevel gear 7, thus transmitting rotation of bevel gear 7 to the inner propeller shaft 9 to drive the propeller 14.

At idle speed, as well as low speeds below the preselected high speed of about 3,000 to 6,000 rpm, pump 57 will operate to deliver fluid through strainer 66 and pressure regulator 83 to the dump valve 84. However, at this time, solenoid 98 will be energized and valve 96 will be in the position shown in FIG. 10, so that hydraulic fluid will be dumped through gap 113 to the sump or reservoir 46. As the fluid is dumped to the sump, the pressure of the fluid being delivered to the piston 47 will not be sufficient to overcome the force of the springs 49 on piston 47, so that the piston 47 will be in a disengaged condition.

When the engine speed reaches the preselected elevated value, an electronic control unit, not shown but described in the aforementioned patent application, will deenergize solenoid 98, so that the valve 96 will be moved by spring force to the position shown in FIG. 9, and pressurized fluid will be delivered to clutch 34, as previously described, to engage the clutch and provide driving engagement between the rotating housing 19 and the outer propeller shaft 27. Thus, both propellers 14 and 30 will rotate in opposite directions and at the same speed. On slowing down from the high speed, both propellers will continue to operate at reduced engine rpm down to a second pre-selected value, generally in the range of about 1,400 to 1,800 rpm. The electronic control unit will then energize solenoid 98 to move valve 96 to the position shown in FIG. 10 and dump fluid to reservoir 46. This permits the springs 49 to move the clutch 34 to the disengaged position to disengage the drive of the outer propeller shaft 27 and propeller 30.

In reverse operation of the watercraft, clutch 15 is moved to the left, as shown in FIG. 2, through operation of rod 26, causing the clutch teeth 17 to engage the teeth 18 on housing 19. As housing 19 is threaded to bevel gear 8, clutch 15, along with the inner propeller shaft 9 will rotate in the opposite direction to move the watercraft in reverse. At this time, the forward propeller 30 will free-wheel. If the engine speed is increased above the preselected value of about 3,000 to 6,000 rpm while clutch 15 is in the reverse position, the solenoid operated valve 96 will be moved to the position shown in FIG. 9, connecting the outlet line 108 to the clutch 34, but as the pump 57, which is connected to the inner propeller shaft 9, is rotating in the opposite direction, the pump will not operate to pressurize the hydraulic fluid, so that the multiple disc clutch 34 will not be engaged, even at high speed when the watercraft is operating in reverse.

If clutch 15 is in the neutral position, and the engine is revved to a high speed above the pre-selected value, the control unit will cause the solenoid operated valve 96 to be moved to the position shown in FIG. 9, connecting the valve outlet 107 with the multi-disc clutch 34, but in the neutral position of clutch 15, pump 57 will not be operated. Thus, even if the engine speed is increased to above the pre-selected value when clutch 15 is in neutral, clutch 34 will not be engaged and the outer propeller shaft 20, along with its propeller will not be operated.

What is claimed is:

1. A marine propulsion unit comprising a housing, a vertical drive shaft journalled in said housing and operably connected to an engine, a lower horizontal propeller shaft journalled for rotation in said housing and selectively driven by said vertical drive shaft, a hydraulic pump located within said housing and operatively driven by said engines, wherein said hydraulic pump in said housing is operatively connected to one of said shafts and driven by rotation thereof, wherein said housing includes a lower torpedo in which said propeller shaft is rotatably journalled, and wherein said hydraulic pump is in said torpedo and driven by said propeller shaft.

2. The invention according to claim 1 wherein said propeller shaft extends fore to aft in said torpedo, said propeller shaft having an aft end for mounting a propeller, said propeller shaft being driven by said drive shaft at a bevel gear, and wherein said hydraulic pump in said torpedo is forward of said bevel gear.

3. The invention according to claim 2 wherein said hydraulic pump is a rotary pump coaxially aligned with and rotating about the same rotational axis as said propeller shaft.

4. By The invention according to claim 3 wherein said torpedo has first and second hydraulic fluid chambers respectively fore and aft of said hydraulic pump.

5. The invention according to claim 4 wherein said second hydraulic fluid chamber is between said bevel gear and said hydraulic pump, and wherein said hydraulic pump has an aft inlet receiving hydraulic fluid from said second chamber, and a forward outlet supplying pressurized hydraulic fluid to said first chamber.

6. The invention according to claim 2 comprising a vertical shift rod in said housing and extending downwardly between said bevel gear and said hydraulic pump, said bevel gear being axially aft of said shift rod, said hydraulic pump being axially forward of said shift rod.

7. The invention according to claim 6 wherein said torpedo has first and second hydraulic fluid chambers respectively fore and aft of said hydraulic pump, said second hydraulic fluid chamber being between said bevel gear and said hydraulic pump, and comprising a shift sleeve axially slidable along said propeller shaft, and wherein said shift rod engages said shift sleeve in said second chamber.

8. The invention according to claim 1 comprising a hydraulic fluid reservoir located within said housing, and wherein said hydraulic pump has an inlet communicating with said reservoir, and an outlet supplying pressurized hydraulic fluid to actuate a movable member.

9. The invention according to claim 8 comprising in combination a strainer, a pressure regulator and a valve connected in series and all located within said housing.

10. The invention according to claim 9 wherein said pressure regulator is located downstream of said strainer, and said valve is located downstream of said pressure regulator.

11. The invention according to claim 8 comprising a conduit in said housing carrying pressurized hydraulic fluid from said pump, and a strainer in said conduit and located within said housing downstream of said pump.

12. The invention according to claim 11 wherein said strainer comprises a casing, and a screen element disposed within the casing and having an inlet and an outlet whereby fluid enters said inlet and passes through said screen element to said outlet, said strainer also including a bypass for permitting said fluid to bypass said screen element when the pressure differential across said screen element exceeds a pre-selected value.

13. The invention according to claim 12 including a biasing element for urging said screen element to a first screening position when said screen element is positioned between said inlet and said outlet, said pressure differential acting to move said screen element against the force of said biasing element to a bypass position where said fluid flows directly from said inlet to said outlet.

14. The invention according to claim 13 wherein said screen element is generally cylindrical and has an open end engaged with said casing when said screen element is in said screening position, said screen element also having an outer cylindrical surface that rides against an inner surface of said casing, one of said surfaces having a plurality of longitudinal grooves to permit direct flow of said fluid from said inlet and through said grooves to said outlet when said screen element is in said bypassed position.

15. The invention according to claim 8 comprising a conduit in said housing carrying pressurized hydraulic fluid from said pump, and a pressure regulator in said conduit and located within said housing downstream of said pump.

16. The invention according to claim 15 wherein said pressure regulator comprises a sub-housing and a plunger mounted for movement in said sub-housing and having a surface exposed to the pressure of said fluid in said conduit, said sub-housing having an outlet communicating with said reservoir, a biasing element for biasing the plunger to a first position where the plunger closes off said outlet, said plunger being constructed and arranged such that a pressure of said fluid exceeding a pre-selected value will move said plunger against the force of said biasing element to open said outlet and permit fluid to be dumped to said reservoir.

17. The invention according to claim 8 comprising a conduit in said housing carrying pressurized hydraulic fluid from said pump, and a valve in said conduit and located within said housing downstream of said pump.

18. The invention according to claim 17 wherein said valve comprises a valve body and a valve member movable within said valve body, and a solenoid having a solenoid plunger operably connected to said valve member for moving said valve member from a first position to a second position.

19. The invention according to claim 18 and including one or more resilient members connected to said valve member for biasing said valve member to said first position.

20. The invention according to claim 19 wherein said one or more resilient members comprise a pair of concentrically mounted springs disposed to interconnect said valve body and said valve member, the first of said springs having a lesser spring force than the second of said springs, and said first spring acting to hold said valve member in said first position, and said second spring constructed and arranged to act on said valve member after said valve member has moved a predetermined distance toward said second position under the influence of said solenoid.

* * * * *

UNITED STATES PATENT AND TRADEMARK OFFICE

CERTIFICATE OF CORRECTION

PATENT : 6,176,750 B1

DATED : January 23, 2001

INVENTOR(S) : CHARLES F. ALEXANDER, JR. ET AL

It is certified that error appears in the above-identified patent and that said Letters Patent is hereby corrected as shown below:

On the title page, item

(75) Inventors: After "Alexander" insert -- Jr. --.

IN THE CLAIMS

Claim 1, column 9, line 46, delete "engines" and substitute therefor - -engine --.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*